US010806220B2

(12) United States Patent
McManus

(10) Patent No.: US 10,806,220 B2
(45) Date of Patent: Oct. 20, 2020

(54) FABRICS FASTENING APPARATUS, METHOD AND SYSTEM

(71) Applicant: Marcia A McManus, Pompano Beach, FL (US)

(72) Inventor: Marcia A McManus, Pompano Beach, FL (US)

( * ) Notice: Subject to any disclaimer, the term of this patent is extended or adjusted under 35 U.S.C. 154(b) by 403 days.

(21) Appl. No.: 14/423,703

(22) PCT Filed: Aug. 26, 2013

(86) PCT No.: PCT/US2013/056692

§ 371 (c)(1),
(2) Date: Feb. 24, 2015

(87) PCT Pub. No.: WO2014/035909

PCT Pub. Date: Mar. 6, 2014

(65) Prior Publication Data

US 2015/0237969 A1 Aug. 27, 2015

Related U.S. Application Data

(60) Provisional application No. 61/693,754, filed on Aug. 27, 2012.

(51) Int. Cl.

| | |
|---|---|
| ***A41D 25/00*** | (2006.01) |
| ***A44B 6/00*** | (2006.01) |
| ***A41D 25/02*** | (2006.01) |

(52) U.S. Cl.

CPC ..... *A44B 6/00* (2013.01); *A41D 25/001* (2013.01); *A41D 25/02* (2013.01); *Y10T 24/199* (2015.01); *Y10T 24/45* (2015.01)

(58) Field of Classification Search

CPC ..... A44B 6/00; A41D 25/001; A41D 25/02; Y10T 24/199; Y10T 24/45

USPC ..... 24/66.3, 66.7, 66.8, 66.9, 66.11, 66.12, 24/66.13

See application file for complete search history.

(56) References Cited

U.S. PATENT DOCUMENTS

| | | | | |
|---|---|---|---|---|
| 2,316,002 A * | 4/1943 | Koivisto | ..... | A41D 25/022 2/144 |
| 2,553,437 A * | 5/1951 | Burke | ..... | A41D 25/022 2/150 |
| 2,605,473 A * | 8/1952 | Halsey | ..... | A41D 25/022 2/153 |
| 2014/0317831 A1* | 10/2014 | Woody | ..... | A41D 25/025 2/152.1 |

* cited by examiner

*Primary Examiner* — Jack W Lavinder
(74) *Attorney, Agent, or Firm* — The Miller Law Offices PLC; Steven J. Miller, Esq.

(57) ABSTRACT

This invention is for any geometrical shapes or knots shape semi or full detachable from a neck wear assembly commonly use as in ties, scarf, cravats but not limited to. This can be used to replicate the look of knots or other geometrical shapes. This invention is the most convenient for the consumer who wants to be on the go and look professional and stylish without sacrificing the quality. The shapes make it appear as if the consumer spent a lot of time to have the perfect tie knot shape. It also gives the feel of a regular neckwear tie, scarf or cravat without the hassle. These shapes have helped solve this issue where anyone can put the knot shapes on without help other than reading or viewing the instructions once.

Consumers can have tie at different lengths without having to redo the tie.

1 Claim, 12 Drawing Sheets

101 A

102 B

103 C

201 A

202 B
203 B

204 C
205 C

301 A

302 B
303 B

304 C

305 D

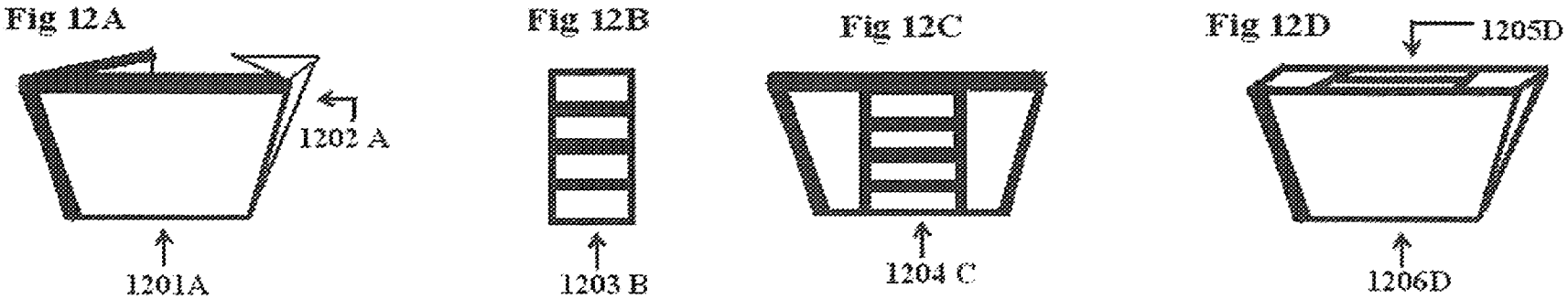
Fig 12D
Fig 12C
Fig 12B
Fig 12A
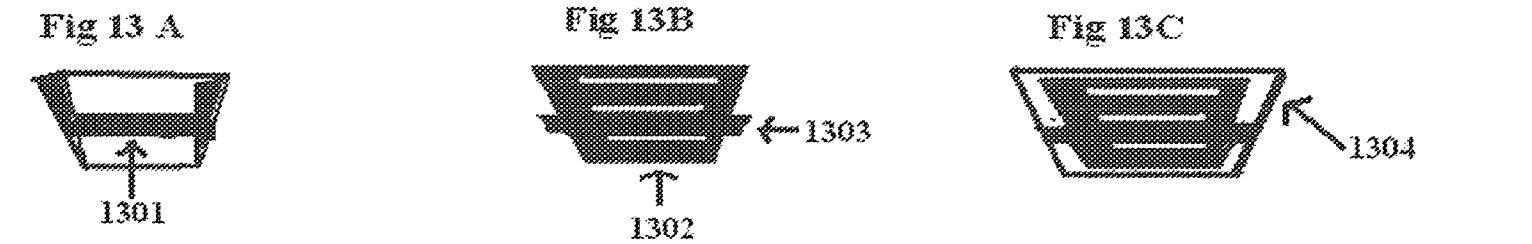
Fig 13C
Fig 13B
Fig 13 A
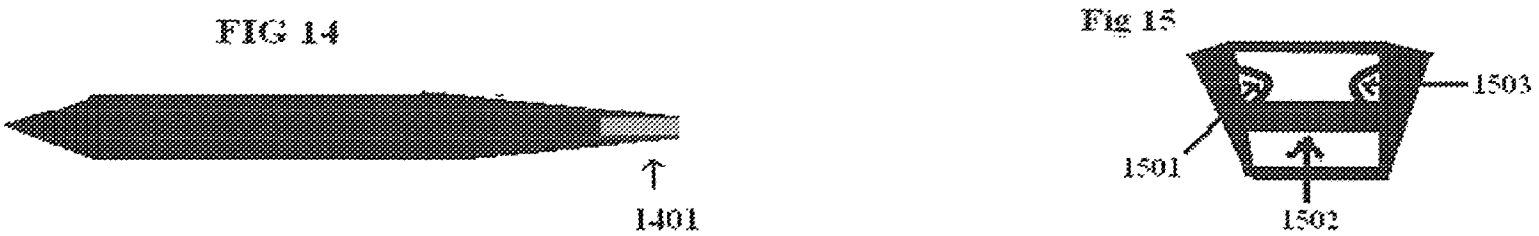
Fig 15
FIG 14

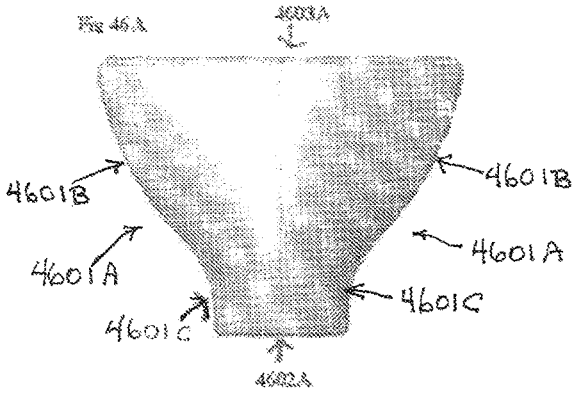
4601B
4601B
4601A
4601A
4601C
4601C
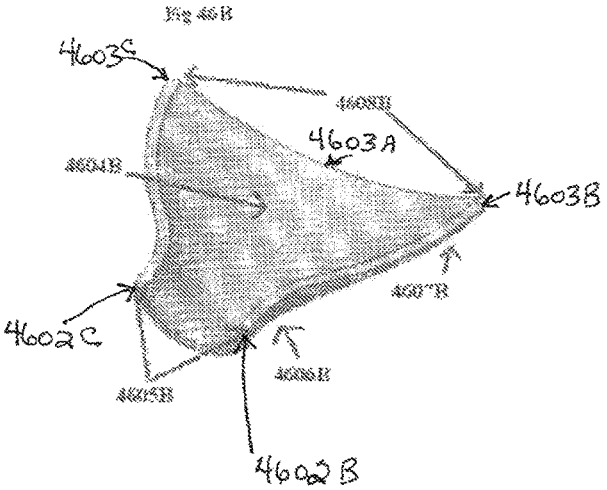
4603C
4603A
4603B
4602C
4602B

FABRICS FASTENING APPARATUS, METHOD AND SYSTEM

CROSS-REFERENCE TO RELATED APPLICATIONS

This application is Non-Provisional PCT Application claiming priority from U.S. Provisional Application No. 61/693,754 filed on 27 Aug. 2012.

STATEMENT REGARDING FEDERALLY SPONSORED RESEARCH AND DEVELOPMENT

Not Applicable.

THE NAMES OF PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Simulated knots and Geometric shapes including actual simulated knots on clip on, zip on, Velcro, Regular Ties but not limited to Tie, Scarf, Cravat, neck wear, bow tie and Hair/pocket/clothing/shoes/belts accessory. Also used as a container to hold items for example flowers on a jacket. Other functions may include household items for example curtains tie backs but not limited to. The knot can be referred to by any name but the function and the purpose remains the same as the simulated knot. Knots can be used on humans, animals in other objects.

Pocket Square Design/Pre-Fold

The pocket square is designed to give the consumer many different designs options for a versatile look within the same pocket design. When folded in different directions the pocket square has different unique or distinguish looks. This will be cost effective for the consumer for multi-use and options. Some pocket square will come pre-folded so all the consumer needs to do is put it in their pocket Clip on Tie The clip-on tie can be regular stationary length or adjustable length. The knot used on either version can be made with interchangeable tie knots or affixed tie knots.

Hook on Simulated Knots

This unique design simulated know only need minimum 1 hook at the back to close and keep tie and knot in place securely. Other designs may vary for example scarfs may use side hooks to close simulated knot. (FIG. 46F-4611D/FIG. 50-5003C)

Tie Knot Accessory/Tie Accents

Specific accessory will be design and manufactured for the Tie Knot.

All tie knots can be with or without accessories. Tie Knots can be decorated with Precious stones, metals, Minerals, Costume stones, crystals, metal, beads, lace, appliqué, stickers, machine made designs, custom or special made accessory pieces. Some Tie Knot has a special opening inside the tie knot that allows the consumer to place an accessory on the outer layer after purchase for example an earning like accessory can be place in the middle of the tie know for unique look but not limited to that location. (FIG. 46D and FIG. ad). Tie can also be decorated with or without same accents as Tie Knot Label/Loop Still (FIG. 51)

The device is attached to the label, loop or any part of the tie so when part is fastened on the shirt it keeps the tie in place without shifting.

Package

Unique for the simulate knot and or Ties to have a better visual display.

Description of Related Art Including Information Disclosed Under 37 CFR 1.97 and 1.98.

Prior Art. Knots/Ties/Scarf

There are several ways to get a knot on a tie including:

a. Clip on tie. However, the clip shows at the top and it is not attractive.
b. Zipper tie and knot. The tie looks inexpensive and inferior.
c. Regular tie. Very classy when the knot is tied right. Very difficult to do.
d. Velcro neck band attachment
e. Bolo tie
f. Triangular shape device . . . to make the perfect shape however you have to know to tie a knot and it takes lots of practice
g. The Zip on, clip on, Velcro ties, regular ties but not limited to, knots are not interchangeable. Or have two or multi tone design and from the body of the tie.

The Prior Art is very complicated and not user friendly (Prior Art includes U.S. Pat. Nos. 4,748,692 and 3,999,222. New invention eliminates all the hassle to get it right the first time.) Both of said prior art references are very complicated for the consumer.

Instant Simulated Knots and Geometrical Shapes (Updated Art)

Including actual knots on clip on, zip on, Velcro, Regular ties but not limited to for Tie, Scarf Cravat, bow tie, neck wear bow tie and Hair/pocket/clothing/shoe/belt accessory 1. These knots/geometrical shapes can slide on, snap on, hook on or any other method that makes the shapes semi, fully adjustable, portable or removable.
2. Some design knots can also be attached to one side of the tie (e.g. broader side) and then the user only needs to adjust the narrow side of the tie into the accessory holder and wear it.
3. This enables the consumer to have a professional looking knot instantly
4. It is very convenient and no longer takes multiple times to get the perfect knot and tie at the desired length.
5. Adults . . . Easy to assemble, very convenient, trendy, affordable and stylish and interchangeable knots for different looks.
6. Kids/Pets/Animals . . . Currently most kid's ties are a smaller version of adults ties. Interchangeable knots offer parents a chance to make the kids ties look individual by having personalized or customized images or mix and match designs and images.

7. The Zip on, clip on, Velcro, Regular ties but not limited to knots can now be interchangeable with two or multi tone designs or shapes, which is different from the rest of the tie body.

8. The knot can also be 1 or more color and the tie can be 1 or more color which can be the same color and design as the tie knot or different 9. Much more efficient and easy to put logo and other images on any part of Knot or neck wear.

10. Some designs of the simulated knots can be used on regular ties or attached independently from a tie on to a garment as a new trend. (e.g. the bathing suite example in the drawings or hair clips)

Prior Art Towel Wrap/Cape/Body Wrap/Bathing Suits/Clothing Article (But Not Limited to)

Towel wrap prior art U.S. Pat. No. 6,986,163,B2 This is used for a different purpose Updated Art Towel Wrap/Cape/Body Wrap/Bathing Suits/Clothing Article but not Limited to Towel . . . The slits make the towel transform into a fun costume or cape for the kids and adults. It more visually appealing than the big traditional knot used to tie both ends of the towel to attach around the consumer shoulder.

Swimsuits bottom . . . In a new style, trend and design for the traditional bathing suit for an updated modern version with the slit used to hold the back and front together.

Swim suit wrap or body wrap. Modern version to knot a body or swim wraps without the big knot at the sides or middle when the wrap is in use. The use of the slits makes a more appealing look for the swim wrap.

Prior Art . . . Fabric Diaper (Can be Reusable)

The prior art on diaper needs to be used with pins to keep material in place which is not always safe and can cause injury to child and adult.

Updated Art . . . Fabric Diaper (Can be Reusable)

Technique can be used in diaper, headbands $^{E}$ ties, scarf, underwear, sari, but not limited to. This is a safer way to use a fabric diaper or any reusable diaper without the use of safety pins that can become detach and cause injuries to babies or adults. The slots are used as a barrier to hold the material in place safely. It also reduces the time cost spent looking for pins or buying pins to completed the traditional diaper set. This is a more economic and safer diaper version.

Prior Art . . . Pocket Square Design

Current pocket squares are not designed give the consumer several design options on the same pocket square.

Updated Art . . . Pocket Square Design/Pre-Fold

With this new design, the consumer has several options how to fold the pocket square to get various combinations and different looks by color and or design. The consumer can now wear one pocket square with several out fits or ties with a different view of the pocket square design each time. This reduces the cost to buy a pocket square for each tie to match.

Some pocket square will come pre-folded so all the consumer need to do is put it in their pocket and it's that easy and it will always be perfect. Currently it takes a lot of effort to get a unique pocket square design fold for pockets.

Prior Art . . . Adjustable Clip on Tie with Separate Tie Knots

The clip-on tie was adjustable but the tie knot was not separate after purchase by the consumer Updated Art . . . Adjustable Clip on Tie with Separate Tie Knots The Tie knot is separate from the tie so the consumer can choose their style, color and design to be simple or mix and match. New fashion trend for clip on tie.

Other option is to use the same device that is in the separate tie knot in the fixed clip on knot so the dimple and other features is more a realistic shape to the consumer. Current clip on ties consumer can visually tell the difference if it was a real tie knot or Simulated tie knot from clip on. Our design is elegant and simple for the consumer. With The clip-on tie can be adjustable to different lengths.

Prior Art . . . Tie Knot Inner Device

The device did not assist to form the dimple shape after purchase by the consumer or allow the consumer to mix and match knots after purchase. Also, prior art did not have a hold in the inner layer (plastic) so the consumer can attach jewelry, etc. for a custom look Updated Art . . . Tie Knot Inner Device This device allows the ties to have several shapes of dimples as desired by the consumer and it is held in place firmly.

Some Clip-on ties has the option to adjust the tie length from inside the tie knot. Current design only adjusts the clip-on tie by the collar only.

The inner layer can have several holes or 1 hole so the consumer has the option to dress the Tie Knot with any accessory after purchase for a custom look. For example, the consumer can put as diamond earring or initials.

Prior Art . . . Real Tie Knot on Regular Ties

The Tie Knot can be made into many design on real ties for example, Windsor, Trinity, Eldredge, Ediety, Han, the cross, etc.

Updated Art . . . Simulating Some Real Tie Knot Designs

Some of the simulated knots can be made looking like the simple designs while other will be made to look more like complex designs for example Eldredge Tie Knots but not limited to.

New Art. Braid or Custom Fabric for Simulated Knots. Technique can also be used for Regular Real Tie Knots Tie knots will be made for different purposes including Uniform/Costume Versions but not limited to. Uniform version will have a braid to match the uniform. For example, gold, silver, white but not limited to those colors. This is normally used in the Military, Pilot, Navy, Marine, Costume industry but not limited to.

The braid can be sewn on the simulated outer layer or it can be custom design into the fabric for the same effect. This design was never done before for simulated knots or Real Tie Knot.

New Art. Reversible Simulated Knot

If the braid is sewn on the simulated knot some design will allow the simulated knot to be reversible from having a braid to being a regular simulated knot without the braid when the braid is turned inside.

Other designs can be made reversible also.

New Art. Hook Knots on Simulated

The hook at the back of knot is a main feature, which holds the tie and tie knot in place. It can close at the back or at the sides in other designs if used on a scarf. There is no Extra feature required holding the simulated knot and tie, unless it is for decorative purposes. The hooks can be made in several shapes but function remains the same Updated Art . . . Tie Knot Accessory/Tie Accessory The consumer has the choice to add any accessory to the tie knot or it can be sold with specific accessories to make the tie knot unique. We will also manufacture specific accessory for all simulated knots.

Prior Art . . . Label/Loop Still

Still using a tie clip, which was attached to the front of the tie and the shirt, held the Tie. This can be very expensive for the consumer to purchase separately.

Other companies have a smaller version of the Tie clip temporarily attach to the tie and it's included in the price.

However, with this option the consumer has to use an inexpensive version of a tie clip and some are not very fashionable.

Other companies use a tie anchor. This option is very bulky for the consumer and not very flattering to the back of the tie.

Updated Art . . . Label/Loop Still (FIG. 51)

This product attaches to the back of the tie and then on the shirt. The tie stays in place and the device is not visible from the front.

It can also adjust a few inches up or down in case it is near a button.

The consumer has the security of having the tie stay in place without any extra accessory showing in front or extra cost to buy a tiepin, which is visible and can only be used most times in the middle of the tie.

Our label/loop still can be placed at the bottom of the tie to maximize the effectiveness of the still but not limited to that location on the design.

Prior Art. Package

There are several versions of Tie boxes

Updated Art . . . Package

Our design is unique because it displays the Ties, Knots and or other accessories through a rear window also. This gives the consumer an option to view product from several angels. This front and rear display is not limited to Tie and Knots.

FIELD OF THE INVENTION

The present invention relates to simulated tie-knots primarily for use as human apparel, but may be used for other purposes as further described herein.

BRIEF SUMMARY OF INVENTION

Instant Simulated Knots and Geometrical Shapes

This invention is for any geometrical shapes or knots shape semi or full detachable or permanently affixed from a neck wear assembly commonly use as in ties, scarf, cravats, bow ties but not limited to. This can be used to replicate the look of knots or other geometrical shapes.

Inner device can also be used in Clip-on tie so it forms the simulated knot shape better for the end product. It can also give the consumer the option to fix dimple how they prefer to wear their tie and some of the clip-on tie knots can be interchangeable.

Not all the simulated knots will have a plastic device inside. The device inside can be made of any material. Some knots will have a stiffener material to hold the shape and can be used alone or in combination with any other device inside the knot.

Convenient

This invention is the most convenient for the consumer who wants to be on the go and look professional and stylish without sacrificing the quality and time. The shapes make it appear as if the consumer spent a lot of time to have the perfect tie knot shape. It also gives the feel of a regular neckwear tie, scarf or cravat, bow tie without the hassle.

Lots of consumer before could not help someone to tie a tie without standing behind the person to demonstrate. These shapes have helped solve this issue where anyone can put the knot shapes on without help other than reading or viewing the instructions once.

It is also beneficial to the disable consumer who may have difficulty to knot the tie by him or herself. These options give the consumer the chance to be independent.

Consumer can also mix and match these knots with their own selection of ties for recycle and get a new look on a previous worn tie, which is cost effective.

Adjustable

Consumer can have tie at different lengths without having to redo the tie. This is helpful when the consumer does not want the tie all the way to the top of the shirt collar certain times during the day/night.

It also helps the consumer to have the perfect custom fit tie length, which is adjustable with their height and size. It becomes a custom tie without being a special made custom tie.

Automatic Dimple

With the apparatus inside the Tie Knot it allows the tie to form a simple dimple automatically when closed and fasten to the necktie. This makes the finish product (Tie and Tie Knot) look Elegant and better than the current versions of clip on tie. It gives it a continuous and unique finish where the tie and tie knot meets.

Interchangeable Knots Colors/New Trend (General/Regular Ties)

The knots come in different colors. Because they can be separated from the tie it allows the consumer to mix and match tie and knots. This can start a new trend where the consumer can have a tie one-color and knot shape another color. This will create the perfect two-tone or multi tone tie the first time without any hassle. Both male and female can use designs.

Other design knots can be used independently from the tie and attach to other article of clothing as a new fashion trend. The knots can be snap on, clip on, slide on or attach anyway possible to the article it is being placed on.

Some designs ties can be adjustable when attach to the simulated knot.

Interchangeable Knots Colors/New Trend (Zip Ties, Clip on Ties, Neck Ties but not Limited to)

2 Tone or multi tone simulated or actual Interchangeable knot designs or shapes can also be applied to other ties design e.g. zip ties, clip on ties, Velcro necktie but not limited.

Choices

Knots shapes will be packaged differently. Some package will contain a few knot style selections in the same fabric as the tie. This allows the consumer to determine if to use a formal knot shape or casual knot shape.

Other packages will contain different color knot shapes by itself.

Some packages may contain tie, tie knots and Pocket Square.

There are several possible combinations for the package content.

This allows the consumer to mix and match ties and knots in any combination.

Luxury/Successful Image

Bring luxury, success, and sophisticated, professional or casual image to the consumer with each tie knot design at an affordable price.

Personalized/Customized

The knots can be personalized and customized with any image or logo.

Custom Tie Length

Since the Tie will not have a knot on it from the same tie, a new customized tie line will be made to accommodate the new length of the tie needed for the simulated shapes.

Updated Art Towel Wrap/Cape/Body Wrap/Bathing Suits/Clothing Article and Diaper

There was a need to give the consumer a different and better option to utilize the articles they commonly use in a more economic and visual appealing way.

Diapers are now safer to use without pins. Pins could cause accidents and injury to consumer when not used properly.

Pocket Square Design

This concept was developed to give the consumer the option to use one pocket square for several looks and design to reduce the cost of purchasing several pocket squares for the same effect with different out fits or neck wear.

Adjustable Clip on Tie with Interchangeable Tie Knots

Clip on ties were not interchangeable before and this gives the customer the freedom to mix and match design knots, as they prefer.

Tie Knot Accessory

There is no specific Knot Accessory made because the knot was tied before and it would be difficult to add an accessory. Since this is a simulated knot the accessory can now be attached to the knot directly. We will make customized and personalized accessories for the tie knot. Other accessories will be generic for example but not limited to lace, appliqué, multi-layer fabric, stones, metal, and stickers.

Label/Loop Still

This was invented to be more elegant, and functional for the consumer and eliminate the expensive cost for a Tie Clip or Anchor Tie design which is bulky.

BRIEF DESCRIPTION OF THE SEVERAL VIEWS OF THE DRAWINGS

FIG. 1B 102B Back of the accessory to house and secure the tie, scarf, cravat fabric FIG. 1C 103C Combination of the Back and front pieces together for the accessory holder. Transparent for illustration purposes.

Figure 1A:
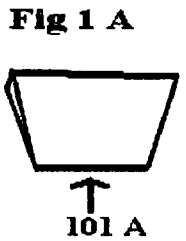
FIG. 1A Simulated knots and Geometric shapes combination Option 1 101A Front of the accessory illustrating the shape of a tie, scarf, cravat knot. The shape can vary depending on which style knot or geometric shape is used.
Figure 2A:
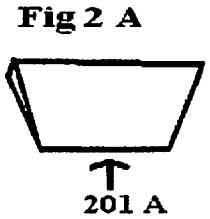
FIG. 2A Simulated knots and Geometric shapes combination Option 2 201A Refer to FIG. 1A, 101A FIG. 2B 202B Dimple indent for the tie shape.
Figure 2B:
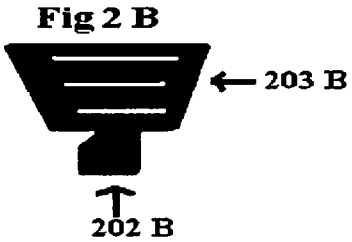
Figure 2C:
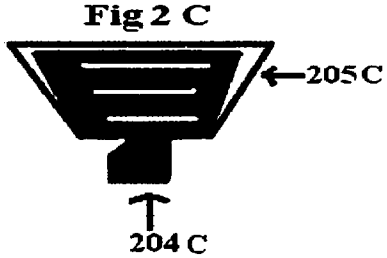
Figure 3A:
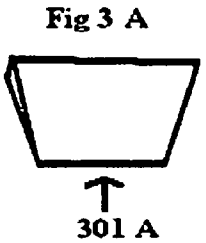
Figure 3B:
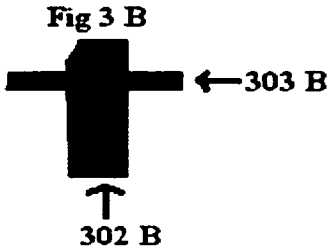

(Prior art . . . Fingers were used to make the Dimple on the tie) 203B Refer to FIG. 1B, 102B FIG. 2C 204C Expose dimple after 2A and 2B are combined 205C Combination of FIG. 2A and 2B FIG. 3A Simulated knots and Geometric shapes combination Option 3 301A Refer to FIG. 1A, 101A FIG. 3B 302B Dimple indent as an additional layer for the accessory 303B Side bars to attach to the rest of the accessory holder as $2^{nd}$ layer.

Figure 1B:
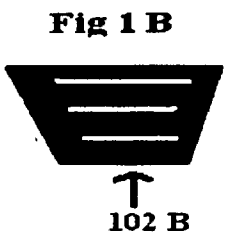
Figure 3C:
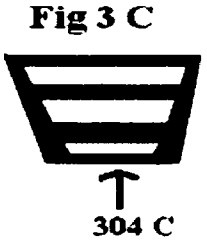

FIG. 3C 304C Refer to FIG. 1B, 102B

Figure 3D:
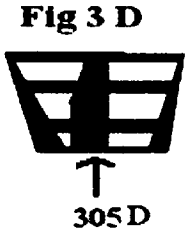

FIG. 3D 305D Combination of layers from 3A, 3B and 3C

Figure 4A:
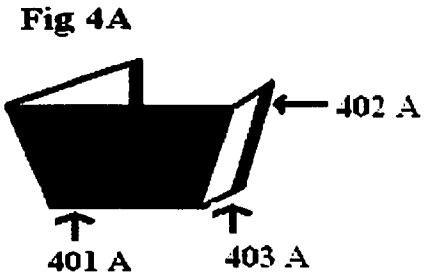

FIG. 4A Simulated knots and Geometric shapes combination Option 4 401A Refer to FIG. 1A, 101A with additional feature of extended sides 402A Closure attachment for the back 403A Extended sides with closure attachment.

Figure 4B:
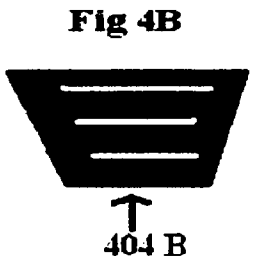

FIG. 4B 404B Second layer, refer to FIG. 1B, 102B

Figure 4C:
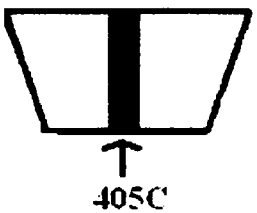

FIG. 4C 405C Combination of FIG. 4A and 4B. The back is fully enclosed.

Figure 5A:
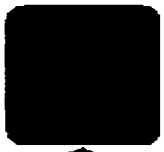

FIG. 5A Simulated knots and Geometric shapes combination (suitable for scarf & cravats, etc.) 501A Refer to FIG. 1A, 101A however the shape is different. Shape can be several geometrical shapes.

Figure 5B:
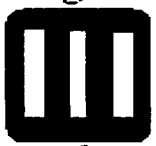

FIG. 5B 502B Refer to FIG. 1B, 102B Similar but straps are in the opposite direction to secure fabric.

Figure 6A:
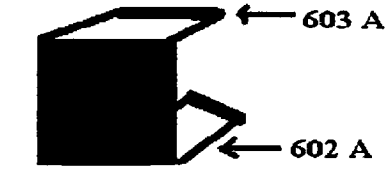
Figure 6B:
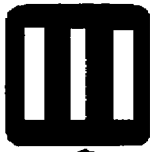
Figure 6C:
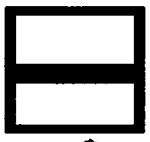

FIG. 6A Simulated knots and Geometric shapes combination Option 6 601A Refer to FIG. 4 Similar but different shape and vertical shape with design 602A Extended sides 603A Extended sides with closure FIG. 6B 604B Refer to FIG. 5B, 502B FIG. 6C 605C Combination of FIG. 6A & 6B 606C back fully enclosed.

Different combination of back to insert fabric

Figure 1C:
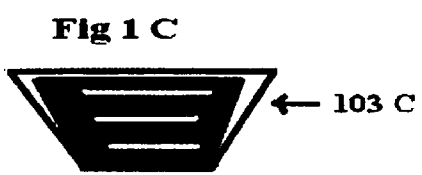
Figure 9:
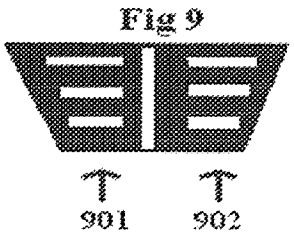
Figure 8:
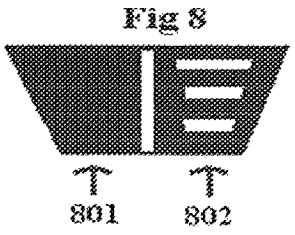
Figure 7:
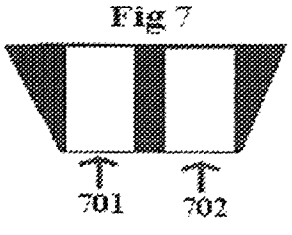
Figure 10:
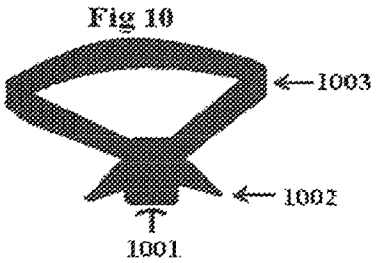
Figure 11D:
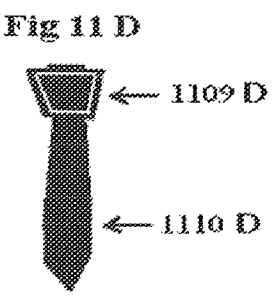
Figure 11C:
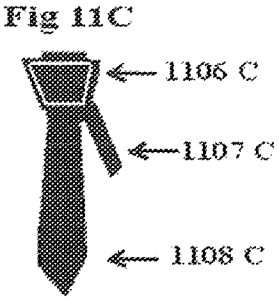
Figure 11B:
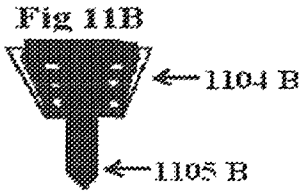
Figure 11A:
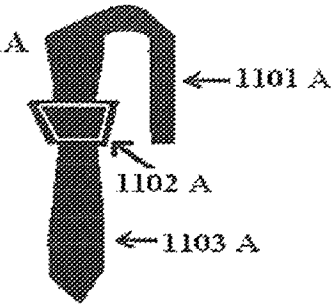

FIG. 7 701 Left channel to insert fabric 702 Right Channel to insert fabric FIG. 8 801 Left channel to insert fabric 802 Right Channel to insert fabric with additional loops for make fabric sturdy FIG. 9 901 Left loop insert channel 902 Right loop insert channel Scarf Sample. Simulated knots and Geometric shapes FIG. 10 1001 Refer to FIGS. 5A& 5B also 6A/6B/6C. Combination to make scarf 1002 Edge of fabric after scarf is completed 1003 Scarf Tie Sample . . . Simulated knots and Geometric shapes FIG. 11A 1101A Narrow end of Tie 1102A Tie with adjustable knot/geometric shape 1103A Broad side of tie FIG. 11B 1104B Combination of back and front of tie with tie loop around 1105B Bottom of narrow end tie FIG. 11C 1106C Refer to FIG. 11A, 1102A 1107C Refer to FIG. 11A, 1101A 1108C Refer to FIG. 11A 11103A FIG. 11D 1109D Combination of FIG. 11A, 11B, 11C 1110D Refer to FIG. 11*a* 1103A Simulated knots and Geometric shapes combination as single unit FIG. 12A 1201A Front of simulated knot or geometric shape 1202A Side of simulated knot or geometric shape FIG. 12B 1203B the strap for the tie narrow end to go through in a weave to ensure the tie stays in place. This strap can be made as part of FIG. 12A as one piece or made separately and attach to FIG. 12A to make 1 piece FIG. 12C 1204C Back view combination of FIG. 12A and FIG. 12B FIG. 12D 1205D Aerial view of FIGS. 12A and 12B showing the straps 1206D Front view of geometric shape FIG. 13A 1301 Bar to hold broader side of tie in place. It can be fixed or adjustable or both sides of the tie can be attached behind the bar FIG. 13B 1302 Refer to FIG. 1/102 1303 Adjustable bar to hold tie in fixed position to further prevent slippage FIG. 13C 1304 Combination of FIGS. 13A & 13B. However, any of these parts can be combined with other parts to make a unique combination.

FIG. 14 1401 Tie with stiffening to help guide the end through the bars easily when adjusting the tie to prevent slippage. The stiffening flexible material can be visible or sewn in to the tie.

Figure 16:
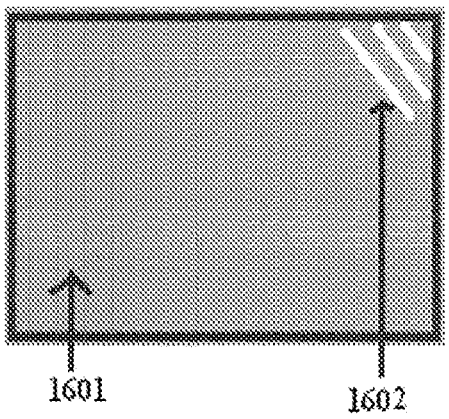

FIG. 15 1501-Left side of tie holder to keep the tie at the side of the simulated knot 1502 Refer to FIG. 13A/1301 1503 Right side of tie holder to keep the tie at the side of the simulated knot Wrap/Cape FIG. 16 1601 Piece of material e.g. towel, sheet, blanket, any size wrap, scarf but not limited to 1602 Slits in material at the edge. When one end is manually weaved in and out of the slit slots it becomes a knot enclosure. Slits slots can be any number on any part of the material and not limited to illustration and can be on any design of fabric listed in 1601 but not limited to. The angle and position of slit slots will depend on the effect the manufacturer wants the consumer to have for that particular piece of fabric.

Figure 17:
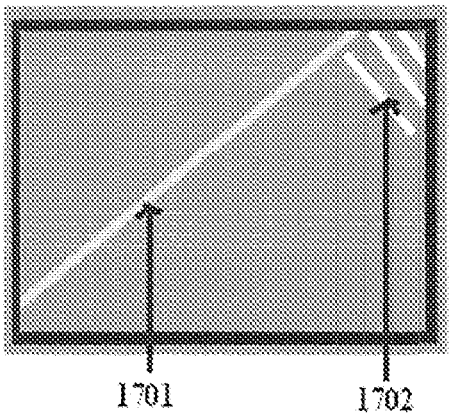

FIG. 17 1701 Illustrating the material will be folded in a triangular shape 1702 Refer to FIG. 16, 1602

Figure 18:
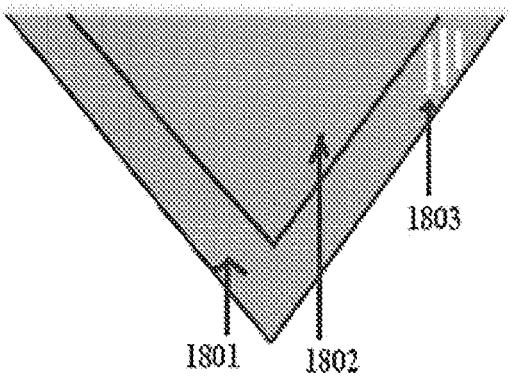

FIG. 18 (Front View) 1801 Bigger triangular shape after fold 1802 Smaller triangular shape after fold 1803 Refer to FIG. 16, 1602

Figure 19:
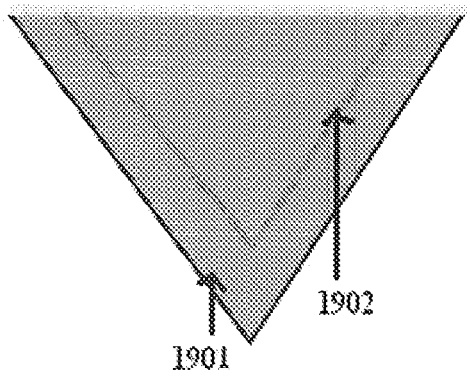

FIG. 19 (Back View) 1901 Refer to FIG. 18, 1801 1902 Refer to FIG. 18, 1802

Figure 20:
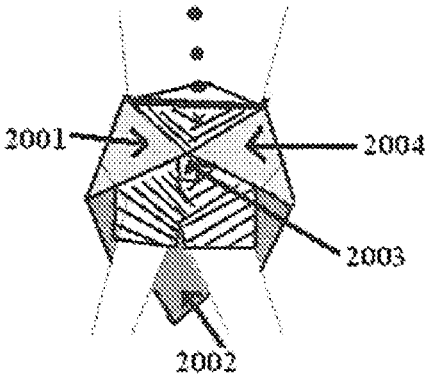
Figure 21:
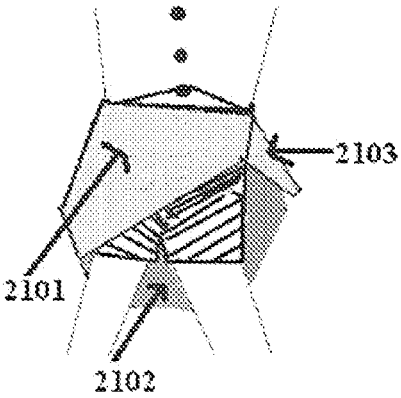
Figure 22:
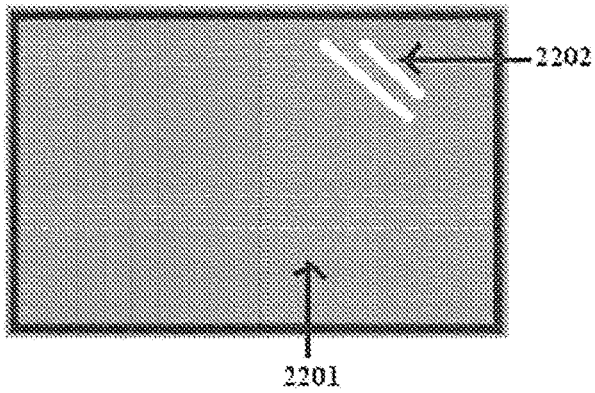
Figure 23:
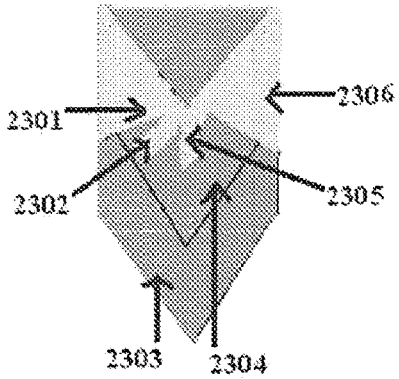

FIG. 20 (Front Wrap view on person on waist) 2001 Right side of Image with fold 2002 Bottom of fold in a point angle 2003 Excess fabric after going through the slit slot to hold two ends together 2004-Left side of image with fold FIG. 21 (Side Wrap view on person on waist) 2101 Refer to FIG. 20, 2001 but fold is angle to the side 2102 Refer to FIG. 20, 2002 but this is a straight bottom instead. 2103 Refer to FIG. 20, 2003 also have option to attach wrap jewelry, into slit as additional design or support, or Velcro or stopper at end of fabric edge FIG. 22 2201 Refer to FIG. 16, 1601 2202 Refer to FIG. 16, 1602 but this design has 2 slit slots for this illustration and is further from the edge than reference figure to create double hang for FIG. 23, 2302 and 2305

FIG. 23 (Body wrap or long skirt wrap illustration but not limited to) 2301 Refer to FIG. 20, 2001 2302 Refer to FIG. 20, 2003 but this has 2 ends instead of 1 2303 Refer to FIG. 20, 2002 2304 Refer to FIG. 18, 1802 2305 Refer to 2302 2306 Refer to FIG. 20, 2004

Figure 24A:
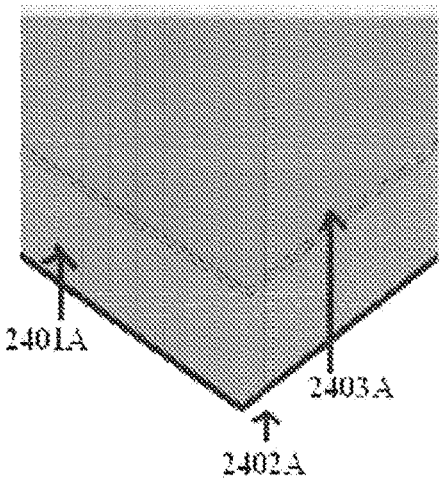

FIG. 24A (Back view of wrap) 2401A Refer to FIG. 19, 1901 shape still pointed but not as triangular as the reference 2402A Refer to FIG. 18 but a slightly different shape because of how the fabric was folded. 2403A Refer to FIG. 19, 1902

Figure 24B:
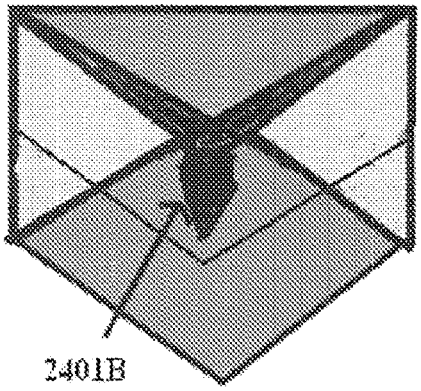

FIG. 24B (Front view of wrap) 2401B Refer to FIG. 20, 2003

Figure 25:
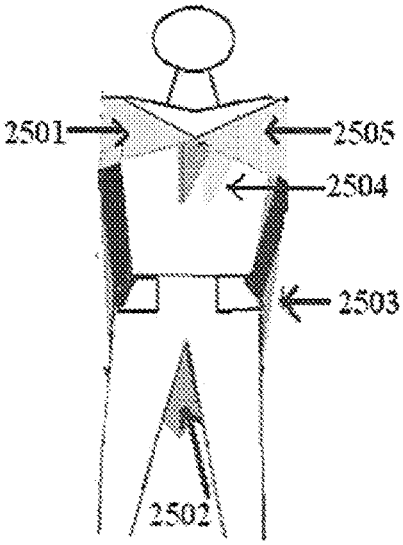

FIG. 25 (Front view of Wrap/Cape) 2501 Refer to FIG. 23, 2301 2502 Refer to FIG. 20, 2002 2503 Long angle wrap/cape 2504 Refer to FIG. 23, 2302 & 2305 2505 Refer to FIG. 20, 2004

Figure 26:
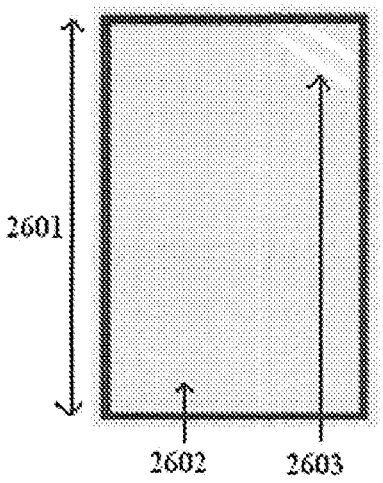
Figure 27:
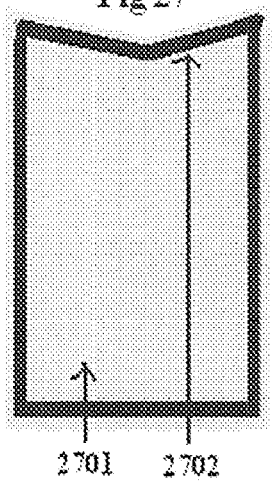
Figure 28:
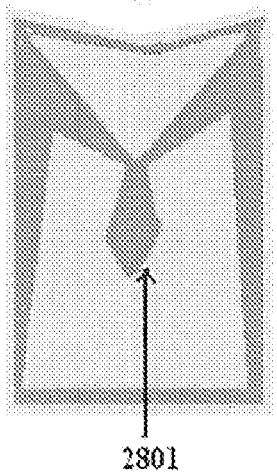
Figure 29:
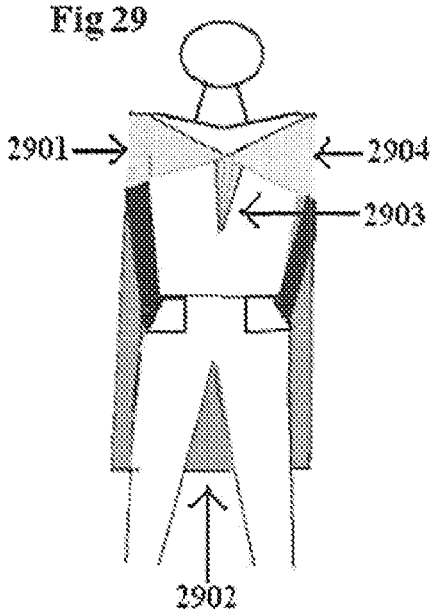

FIG. 26 (Long wrap//towel/sheet/blanket but not limited to) 2601 Length of material 2602 Refer to FIG. 16, 1601 2603 Refer to FIG. 16, 1602 but this has 2 slits slots FIG. 27 (Back View) 2701 Refer to FIG. 26, 2602 2702 Top of fabric folded in an angle FIG. 28 (Front View) 2801 Refer to FIG. 23 but this is the longer version FIG. 29 (Long Cape/Wrap view on person) 2901 Refer to FIG. 25, 2501 2902 Refer to FIG. 25, 2502 but straight version 2903 Refer to FIG. 25, 2504 but single loose end 2904 Refer to FIG. 25, 2505

Fabric Diaper—may be reusable after washing (Drawing is for illustration only and technique can be used in diaper, head bands/ties, scarf, underwear, sari, but not limited to)

Figure 30:
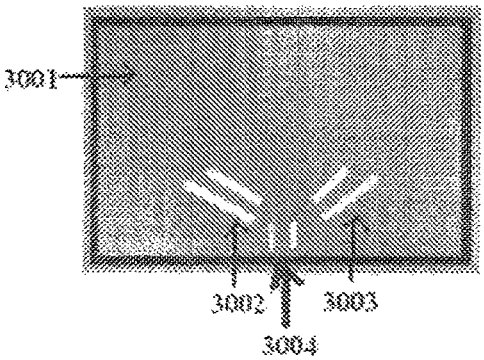
Figure 31:
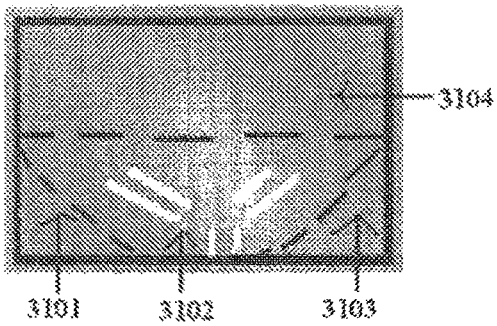

FIG. 30 3001 Fabric to make diaper 3002 Right Slit Slot 3003-Left Slit Slot 3304 Center Slit slot FIG. 31 3101 Right Folding edge to make triangular shape 3102 Refer to FIG. 30, 3002 3103 Left Folding edge to make triangular shape 3104 Refer to FIG. 30, 3001

Figure 32:
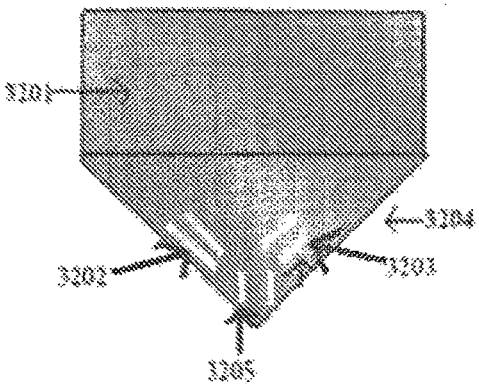

FIG. 32 3201 Refer to FIG. 30, 3001 3202 Refer to FIG. 30, 3002 3203 Refer to FIG. 30, 3003 3204 Refer to FIGS. 31, 3101 and 3103 edge after it is folded 3205 Refer to FIG. 30, 3004

Figure 33:
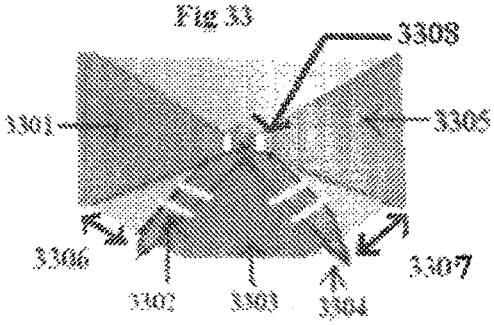
Figure 34A:
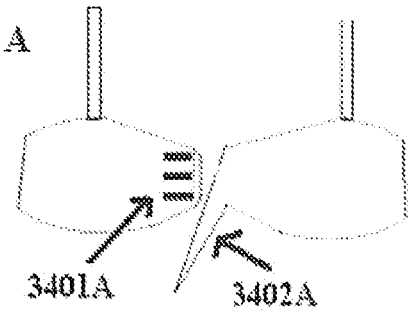
Figure 34B:
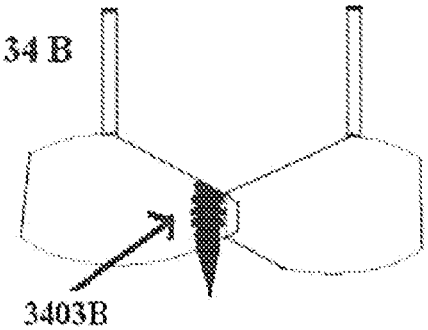
Figure 34C:
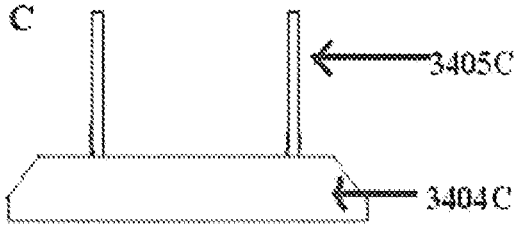

FIG. 33 3301 Right folded edge for the top of Diaper 3302 Right Narrow edge after going through the slit slot 3303 Base of diaper bottom between leg slot and folded edge (3301 & 3305) 3304 Left Narrow edge after going through the slit slot 3305 Left folded edge for the top of Diaper 3306 Right Diaper leg slot 3307 Left Diaper leg slot 3308 Refer to FIG. 30, 3004 both right and left edges go through the slit FIG. 34A Illustration of swim wear top but can be any kind of clothing 3401A Slits to connect the left and right side. Slits can vary in number on all designs (Updated art) 3402A End of fabric to thread through the slits to connect each side of the fabric as 1 unit FIG. 34B 3403B Illustration of left and right side fabric connected FIG. 34C 3404C Back of swim wear top but can be any geometric design. 3405C Straps can be any design or shape either connected or not connected.

Figure 35A:
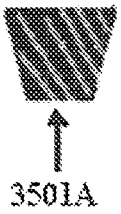

FIG. 35A 3501A Simulated knot

Figure 35B:
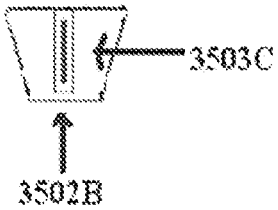

FIG. 35B 3502B Clip on or fastener apparatus for knot. This design is for illustration only. The knot can be made to connect to garments several ways including snap on but not limited to. (Updated art for independent knot without being attached to a tie) 3503B Back of simulated knot design FIG. 36 3601 Simulated knots 3602 Mini Tie (lengths can vary and some designs are adjustable).

Figure 37A:
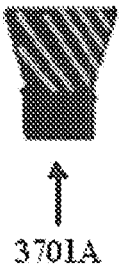
Figure 37B:
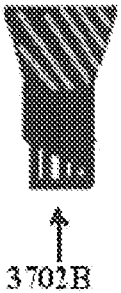
Figure 37C:
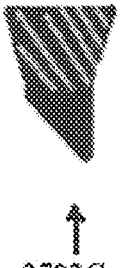
Figure 37D:
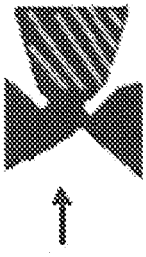

FIG. 37A 3701A Simulated knot and or bottom attachment design illustration as variety choice FIG. 37B 3702B Simulated knot and or bottom attachment design illustration as variety choice FIG. 37C 3703C Simulated knot and or bottom attachment design illustration as variety choice FIG. 37D 3704D Simulated knot and or bottom attachment design illustration as variety choce.

Figure 38:
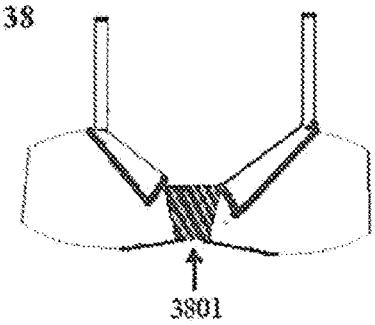

FIG. 38 3801 Refer to FIG. 35A Simulate knot on swim wear top

Figure 39:
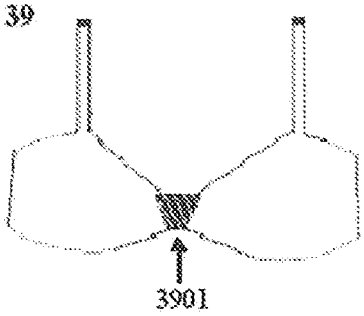

FIG. 39 3901 Refer to FIG. 35A Simulate knot on swim wear top

Figure 36:
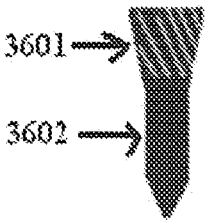
Figure 40:
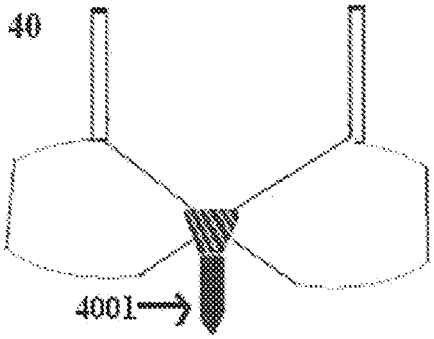
Figure 41:
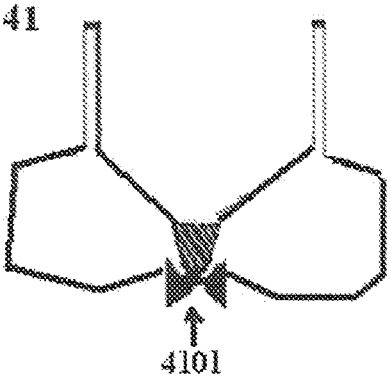
Figure 42:
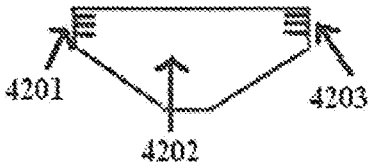
Figure 43:
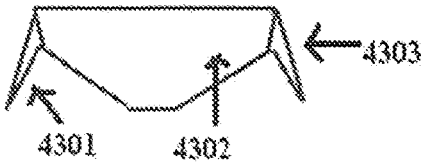
Figure 44:
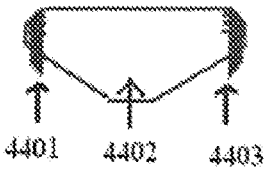
Figure 45:
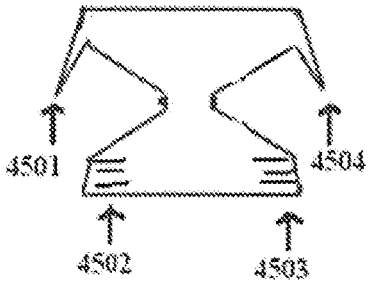

FIG. 40 4001 Refer to FIG. 36 Simulate knot and mini tie on swim wear top FIG. 41 4101 Refer to FIG. 37D Simulate knot and mini tie on swim wear top FIG. 42 4201 Left Front slits to connect back and front of the swim wear. This is for illustration only slits can be any part of the swim wears and number of slits can vary or any clothing article but not limited to 4202 Front of swim wear 4203 Refer to 4201 Right side FIG. 43 4301 Left side strap to go through slit to connect the front and back of swim wear 4302 Back of swim wear 4303 Right side strap to go through slit to connect the front and back of swim wear FIG. 44 4401 Left connected strap in swimwear 4402 Front of swim wear 4403 Right connected strap in swimwear FIG. 45 4501 Refer to FIG. 43, 4301 4502 Refer to FIG. 42, 4201 4503 Refer to FIG. 42, 4203 4504 Refer to FIG. 43, 4303

FIG. 46A. Inner layer/mold (Can be several shapes and sizes and material, this is for illustration only) 4601A Side Curve to form the shape of the mold and also secure the Tie in the simulated knot, there being two side curves whose geometric shape being mirror images of one another 4601B Said two side curves being each being comprised of one concave arc 4601C Said two side curves also each being comprised of one convex arc 4602A Bottom curve same purpose as FIG. 4601A, said bottom curve's shape being a semicircle geometric shape 4602B Bottom curve right end point and one side curve's bottom end point 4602C Bottom curve left end point the other side curve's bottom end point 4603A Top Curve to form the shape of the simulated design at the top, said top curve's shape being an arch shaped curve 4603B Top curve right end point and said one side curve's top end point 4603C Top curve left end point and said other side curve's top end point 4602B, 4602C, 4603B and 4603C all being located in the same geometric plane.

Figure 46D:
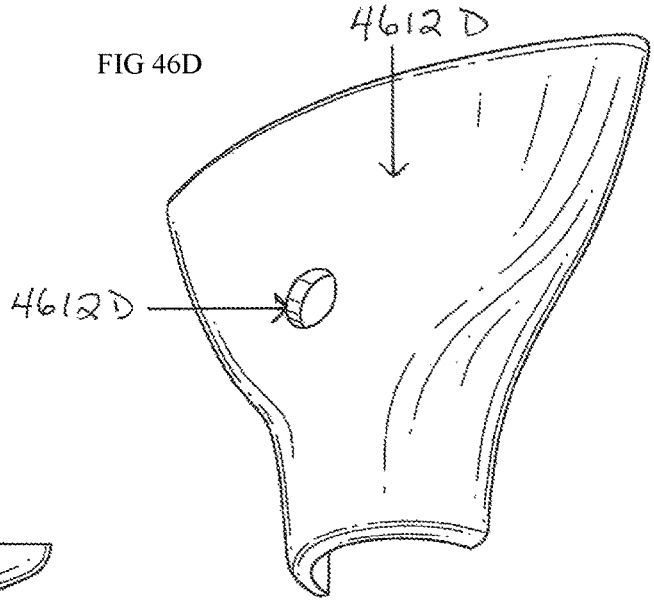
Figure 46C:
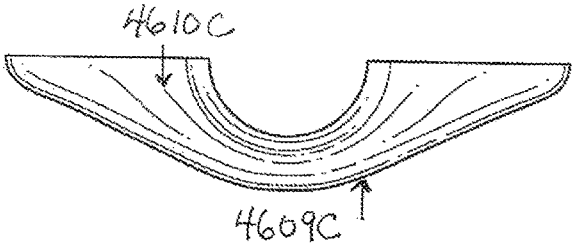

FIG. 46B, back view of FIG. 46A 4604B Hollow inside of simulated knot mold facing backwards 4605B Refer to FIG. 46A/4602A 4606B Refer to FIG. 46A/4601A 4607B Side of simulated knot shape 4608B Refer to FIG. 46A/4603A FIG. 46C . . . Back view 4609C Outer view of 4610C 4610C Top view, simulated knot mold facing forward Refer to FIG. 46B/4604B FIG. 46D 4611D the mold design can have one or more holes. This allows the consumer to place an accessory in the simulated knot after purchase easily for decorative purposes. Our company will manufacture accessory. 4612D Top view of front of simulated knot.

Figure 46E:
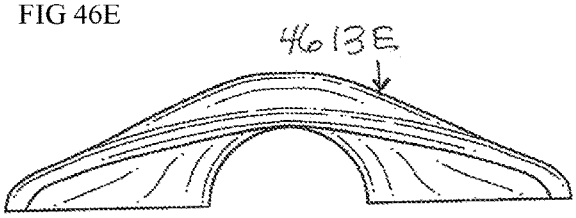

FIG. 46E 4613E Refer to FIG. 46D/4612D different angle

DETAILED DESCRIPTION OF THE INVENTION

Knots/Ties/Scarf/Bow Tie/Loop Slider/Knot Hook/Pocket Square

All designs for the simulated knots and Geometric shapes can be interchangeable or made in a different housing other than what is illustrated. The drawings are for illustration purposes only and not the only way the accessory device can be made. It is to give a prospective by drawing what the shape may look like. The Knots can be in any geometrical shape. The strap design retains tie in a specified position there can also be several straps across or none. The knot housing can be made in different depending on the simulated knot shape. The inner layer of tie knot can be made with different shapes mold. Some design can also contain a fabric stiffener.

Other designs includes where the simulated knots or actual knots are placed on the tie and can be closed securely without requiring the straps. Some designs are secure with a hook, which can be placed at several locations on the knot depending on the use. Not all designs are illustrated in drawings.

This patent also covers all ties, neck wear but not limited to that can use interchangeable knots or simulated knots and or geometric shapes. Also, personalized and customized images on the knot or simulated knot removable or permanent.

The cover for the simulated knots can be made as a cover to compliment the design of the housing. Another method will be to glue on fabric to the housing. There are several methods to achieve the finish look to the simulated knots.

The simulated knots and geometric shapes can be used for other items including window treatment, etc. Tie knots can be attached or simulated as an image on the swim suits or article or clothing.

The package for the tie can be sold in sets of multiple knots and tie to help consumer reduce cost by buying a package deal. The knots can also be sold individually so consumer can mix and match colors.

This invention is very modern and reduces time the consumer takes to make the perfect tie making each tie perfect The tie can be shorter than the regular tie because the knot is not made with the tie, which would require less material for the tie. The tie can also be made with or without a flexible stiffing in order to guide the tie end through the accessory bar easily.

Loop slider is used to secure the tie and shirt together but not limited to that function only.

The knot hook is used to secure the two ends of the knots at the back to secure what may be inside including tie, flowers, etc.

Pocket Square design is used to give consumer several options to reduce cost with a single item.

Towel Wrap/Cape/Body Wrap/Bathing Suits/Clothing Article and Diaper

The different articles mentioned above can have 1 or multiple slits but not limited to the slits shown in the illustration to hold the design and function of the article together.

Material for Simulated Knots, Geometric Shapes, Ties, Swim Suits, Scarf, Diaper, Clothing, Knot Accessories/Pocket Square/Tie Knot Accessory/Loop Slider This invention is not limited to any specific material however it can be plastic, metal, stiffing fabric but not limited to. The method of making the simulated shapes will determine which material is used to guarantee best results.

1. The tie, scarf, neck wear knots, pocket square will be the same color fabric as the tie or can also be different colors, images, logos, personalized and customized.
2. The back straps can be made of an elastic type material, or regular fabric or plastic, metal, stiffening fabric, ribbon but not limited to.
3. The material for the new adjusted length ties can be standard, luxury or custom made.
4. Material for the tie, scarf, Pocket Square can be made of any fabric including silk, polyester but not limited to.
5. Material for stiffing at the end of the narrow side of the tie can be made of any flexible material that can be used as a guide when putting the tie through the knot bars at the back. This can be sewn in the tie and not be visible but not limited to that specific attachment style
6. Material for Swim suits, diaper or any application where this design can be used can be any suitable fabric and material desired by the consumer.
7. Tie knot accessories can be made with precious stones, costume accessories, appliqués but not limited to
8. Loop slider and knot hook can be made with metal or any durable material that may be flexible to hold the tie and shirt secure.

In so far as the description above and the accompanying drawings disclose any additional subject matter that is not within the scope of the limited claims below, the inventions are not dedicated to the public and the right to file one or more applications to claim such additional inventions is reserved.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the claims.

What is claimed is:

1. An instant simulated tie knot apparatus, said instant simulated tie knot apparatus comprising:

an inner layer, said inner layer having a geometric shape of a simulated tie knot design, said geometric shape comprising two side curves, a bottom curve, and a top curve, each of said side, bottom and top curves having two end points, each of said side curves have a top end point and a bottom end point, the top curve has a right end point and a left end point, the bottom curve has a right end point and a left end point, said top curve, bottom curve, and two side curves' end points all being located in the same plane, said bottom curve's geometric shape being a semicircle, said top curve's geometric shape being an arch shaped curve whose diameter is larger than the diameter of said bottom curve's semicircle geometric shape, said two side curves' geometric shape being mirror image shapes of one another, said two side curves' respective top end points each intersect one of the end points of the top curve and in the same plane, said two side curves' respective bottom end points each intersect one of the end points of the bottom curve and in the same plane, said two side curves each being geometrically defined by one convex arc and one concave arc, said side curves' respective concave and convex arcs connecting to one another to define the geometric shape of each of said respective two side curves, said two side curves, bottom curve and top curve, together define a hollow, said hollow facing backward being fully open.

* * * * *